US008141200B2

(12) United States Patent
Barker et al.

(10) Patent No.: US 8,141,200 B2
(45) Date of Patent: Mar. 27, 2012

(54) AIR INLET FOR A VACUUM CLEANER

(75) Inventors: David Barker, Prudhoe (GB); Martyn Riley, Jesmond (GB); Barry Pears, Langley Moor (GB)

(73) Assignee: Black & Decker Inc., Newark, DE (US)

( * ) Notice: Subject to any disclaimer, the term of this patent is extended or adjusted under 35 U.S.C. 154(b) by 949 days.

(21) Appl. No.: 10/876,806

(22) Filed: Jun. 25, 2004

(65) Prior Publication Data

US 2005/0011039 A1 Jan. 20, 2005

(30) Foreign Application Priority Data

Jun. 26, 2003 (GB) ..... 0314945.7

(51) Int. Cl.
*A47L 9/10* (2006.01)

(52) U.S. Cl. ..... 15/347; 15/327.7; 15/352

(58) Field of Classification Search ..... 15/347, 15/327.1, 327.7, 352; *A47L 5/36, 9/10*
See application file for complete search history.

(56) References Cited

U.S. PATENT DOCUMENTS

| | | | | |
|---|---|---|---|---|
| 2,539,195 | A * | 1/1951 | Lang | 15/327.1 |
| 2,771,151 | A | 11/1956 | Osborn | |
| 4,179,768 | A * | 12/1979 | Sawyer | 15/352 |
| 4,527,302 | A * | 7/1985 | Maurer et al. | 15/327.1 |
| 4,745,654 | A * | 5/1988 | Yamamoto et al. | 15/352 |
| 5,699,585 | A * | 12/1997 | Tomooka et al. | 15/327.7 |
| 5,829,090 | A | 11/1998 | Melito et al. | |
| 5,946,771 | A * | 9/1999 | Bosyj et al. | 15/347 |
| 5,966,774 | A * | 10/1999 | Bone et al. | 15/344 |
| 6,256,834 | B1 | 7/2001 | Meijer et al. | |

(Continued)

FOREIGN PATENT DOCUMENTS

| | | |
|---|---|---|
| DE | 1945313 | 3/1971 |
| DE | 10129596 | 1/2002 |
| EP | 1179312 A2 | 2/2002 |
| GB | 2 137 896 A | 10/1984 |
| GB | 2 365 325 A | 2/2002 |

(Continued)

OTHER PUBLICATIONS

Vacuum Cleaner (Abstract) ; Toshihiko, Nagashima : JP19870197098 19870806 Feb. 10, 1989.

*Primary Examiner* — David Redding
(74) *Attorney, Agent, or Firm* — John Yun

(57) ABSTRACT

A vacuum cleaner 2 having a housing 4 having an inlet 12 and an outlet 54 is disclosed. Actuation of a motor 46 causes a fan to displace air out of outlet 54, and the resulting suction upstream of the fan draws dirty air through inlet 12 and inwardly through walls of filter element 22. In order to clean the filter element 22, the user lifts lid 24 by means of gripping portion 32, and then removes filter element 22 and dirt collection chamber 16. Because the central portion of the dirt collection chamber 16 is raised, dirt trapped on the outer surface of filter element 22 has a tendency to fall into trough regions 40, 42 and avoids falling into outlet 38. If the motor 46 should accidentally be actuated when the filter element 22 is removed, the opening provided by opened lid 24 is nearer to outlet 38 than inlet 12, as a result of which relatively clean air from the atmosphere passes into recess 36 in preference to dirty air from the inlet 12, thus minimizing the risk of the motor 46 being damaged by dirt.

5 Claims, 15 Drawing Sheets

U.S. PATENT DOCUMENTS

| | | | | |
|---|---|---|---|---|
| 6,342,084 | B1 | 1/2002 | Pezzaniti | |
| 6,436,160 | B1 * | 8/2002 | Stephens et al. | 55/337 |
| 2002/0088209 | A1 * | 7/2002 | Stephens et al. | 55/337 |
| 2002/0120998 | A1 | 9/2002 | Dubos et al. | |
| 2003/0005547 | A1 * | 1/2003 | Bone | 15/352 |
| 2004/0128791 | A1 * | 7/2004 | Kuroki et al. | 15/353 |

FOREIGN PATENT DOCUMENTS

| | | | |
|---|---|---|---|
| GB | 2373431 | A | 8/2002 |
| GB | 2 374 524 | A | 10/2002 |
| GB | 2 386 056 | A | 9/2003 |
| NL | 42636 | | 9/1937 |

* cited by examiner

AIR INLET FOR A VACUUM CLEANER

FIELD OF THE INVENTION

The present invention relates to vacuum cleaners, and relates particularly, but not exclusively, to cylinder type vacuum cleaners.

BACKGROUND OF THE INVENTION

In conventional cylinder type vacuum cleaners, a motor arranged in a housing of the vacuum cleaner drives a fan, which causes air to be displaced radially outwards of the fan and expelled through vents in the housing. This in turn causes suction upstream of the fan, which draws dirty air into the vacuum cleaner housing, through a suitable filter such as a rigid filter element or a flexible filter bag, the filter being located between an inlet or the housing and the fan. As a result, dirty air is drawn along a suitable accessory such as a flexible hose connected to the housing inlet, enters the inlet and passes through the filter, and cleaner air passes through the fan and is expelled through the vents in the housing.

Known vacuum cleaners of this type suffer from the drawback that if the filter should be removed, for example for emptying or cleaning, while the motor is operating the fan, dirty air can be drawn directly towards the fan without being filtered, as a result of which dirt can cause damage to the motor.

SUMMARY OF THE INVENTION

Preferred embodiments of the present invention seek to overcome the above disadvantage of the prior art.

According to the present invention, there is provided a vacuum cleaner comprising:

a housing having at least one first inlet for allowing intake of air and at least one first outlet for allowing exhaust of air;

suction means for causing air to flow from at least one said first inlet to at least one said first outlet;

filter means located in said housing for removing particles larger than a predetermined size from air flowing from the or each said first inlet to said suction means, said filter means comprising at least one filter element adapted to be removed from said housing; and at least one second inlet having a respective open condition, for enabling at least one said filter element to be removed from said housing, and a respective closed condition, wherein air from at least one said second inlet in an open condition thereof passes to said suction means in preference to air from the or each said first inlet.

By providing at least one second inlet such that air from said second inlet when in an open condition passes to said suction means in preference to air from the or each first inlet, this provides the advantage of causing relatively clean air from the second inlet to pass to the suction means if a filter element should be removed from the housing while the suction means is in operation. This in turn provides the advantage of minimising the risk of damage to the suction means by dirt entering via at least one said first inlet.

The or each said second inlet may be arranged closer to said suction means than the or each said first inlet.

At least one said filter element may be a flexible bag having an opening for receiving air from the or each said first inlet.

The vacuum cleaner may further comprise at least one dirt collection receptacle having at least one respective second outlet, and a respective said filter element is adapted to be mounted to the or each said second outlet such that air passing from the or each said first inlet to said suction means passes through at least one said filter element.

At least one said dirt collection receptacle may be removable from said housing.

At least one said receptacle may comprise a respective recess adjacent at least one said second outlet.

This provides the advantage of enabling dirt released from the external surface of at least one said filter element to be collected in at least one said recess, thus minimising the extent to which said dirt falls into the corresponding second outlet.

The vacuum cleaner may further comprise latching means for releasably maintaining at least one said dirt collection receptacle in position in said housing.

The vacuum cleaner may further comprise at least one closure member having a respective open condition and a respective closed condition for closing at least one respective said second inlet.

At least one said closure member may comprise vent means for allowing intake of air in a closed condition of said closure member when a corresponding said filter element is removed from said housing.

This provides the advantage of ensuring that clean air passes from at least one said second inlet to said suction means even if the corresponding closure member should move to a closed position when a filter element is removed from the housing.

The vacuum cleaner may further comprise sealing means for sealing between at least one said filter element and the corresponding said closure member.

This provides the advantage of preventing leakage of air into said housing through the vent means when the vacuum cleaner is operating normally with the or each said filter element in place in the housing.

At least one said filter element may be mounted to at least one said closure member for removal therewith from said housing.

BRIEF DESCRIPTION OF THE DRAWINGS

A preferred embodiment of the invention will now be described, by way of example only and not in any limitative sense, with reference to the accompanying drawings, in which.

DETAILED DESCRIPTION OF THE DRAWINGS

Figure 1:
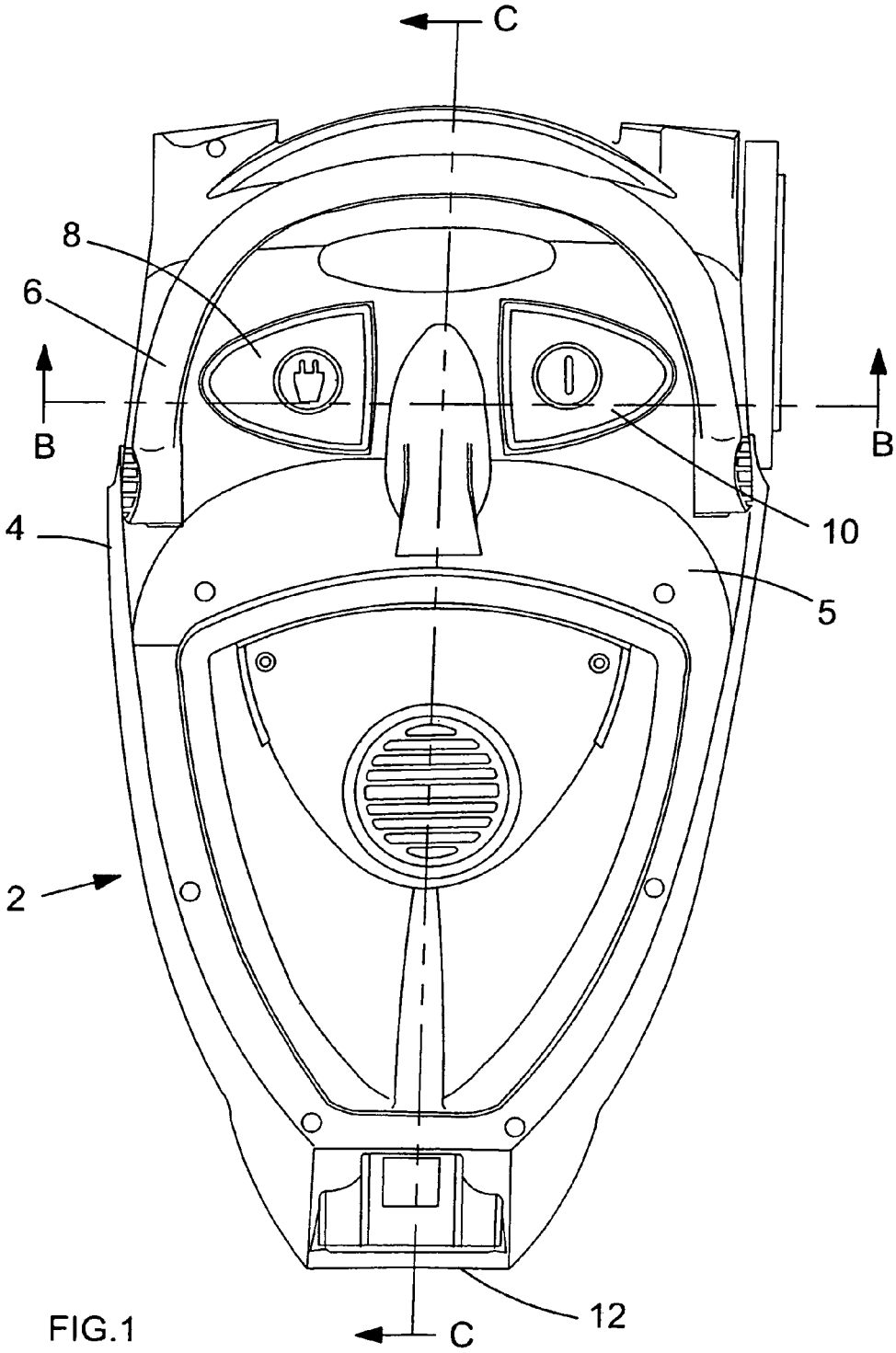
FIG. 1 is a plan view of a vacuum cleaner embodying the present invention.
Figure 2:
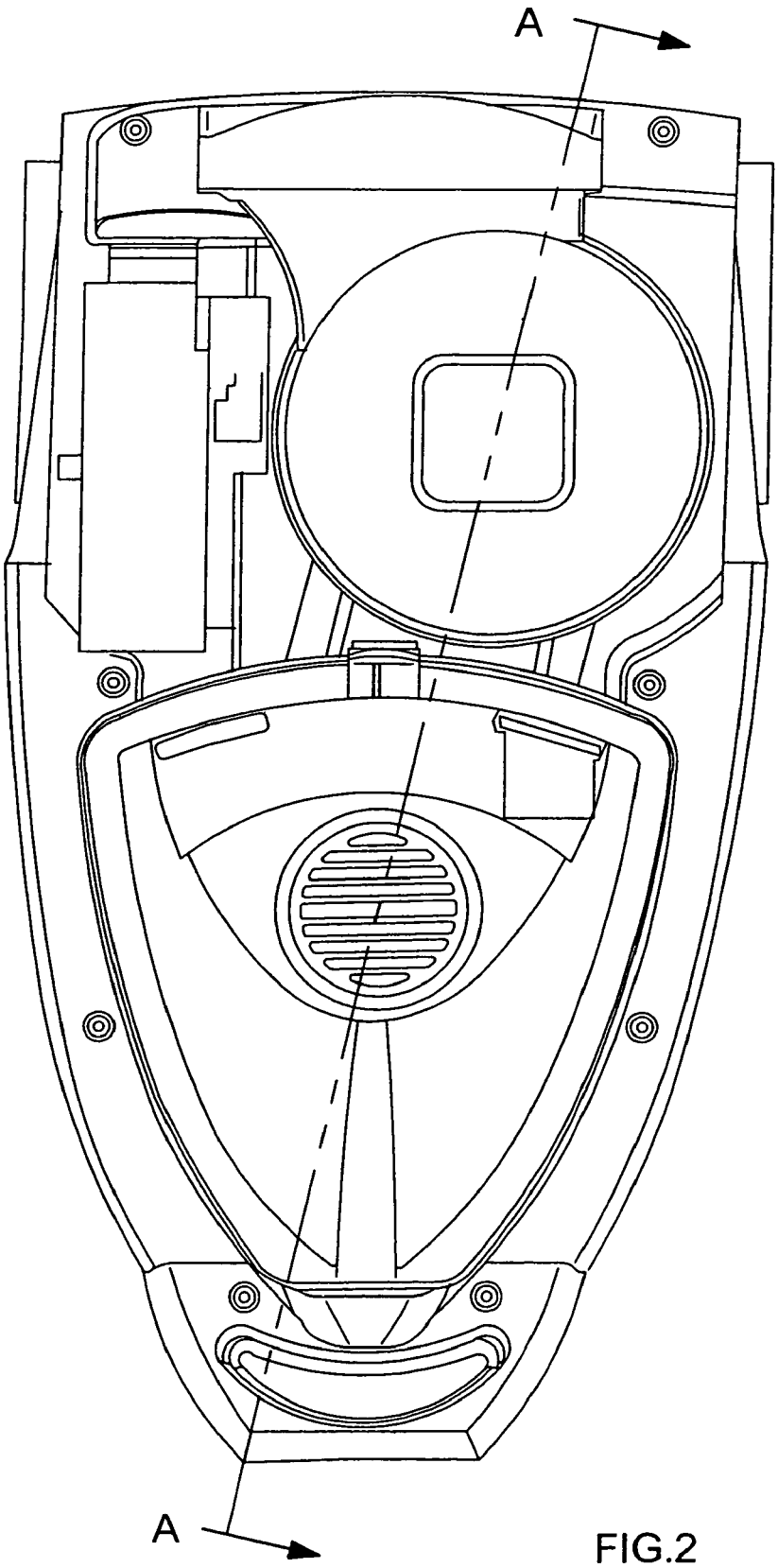
FIG. 2 is a partially cut away plan view of the vacuum cleaner housing of FIG. 1.

Referring to FIGS. 1 to 4, a cylinder type vacuum cleaner 2 has a housing 4 having a main housing part 5, a carrying handle 6 and wheels 7. A cable winder switch 8 and ON/OFF switch 10 are provided on an upper part of the housing.

The housing 4 defines an inlet 12 for connection to a flexible hose 14 (FIG. 12) at one end of the housing. A dirt collection receptacle 16 is removably attached to the housing 4 by means of a suitable latching mechanism (not shown) and defines a dirt collection chamber 18. The receptacle 16 has a central raised portion 20 for sealing engagement with a cylindrical filter element 22 formed from pleated fibrous material, such as paper or textile, covered by a breathable fabric, and is closed by a lid 24 which sealingly engages upper part 26 of filter element 22 by means of an annular seal 28, the annular seal surrounding a vent 30 in the lid 24, the function of which will be described in greater detail below. The lid 24 also has an edge 32 for gripping by a user during lifting of the lid.

The dirt collection receptacle 16 is held in position by the latching mechanism against an inner wall of a recess integrally formed with the main part 5 of the housing 4. The raised portion 20 of the dirt collection receptacle 16 has a central aperture or outlet 38 cooperating with an aperture in upper wall 34 of recess 36, the raised portion 20 being surrounded by first 40 and second 42 trough regions for collecting dirt, in a manner which will be described in greater detail below.

A motor chamber 44 communicates with recess 36 via an aperture 46, and a motor 48 is mounted via sealing mounts 50 for rotation about an axis 52. A fan (not shown) is mounted coaxially with motor 48 and communicates via exhaust outlet 54 with the atmosphere. A filter cassette (not shown) containing a HEPA filter is mounted in outlet 54 for filtering air expelled out of the outlet 54 by means of the fan.

The recess 36 is closed by means of closure plate 56, which is mounted to the main housing part 4, and is provided with a bypass valve 58 for allowing entry of air into recess 36 if the air pressure within recess 36 falls below a predetermined value. In this way, the main housing part 4 can be easily injection moulded, the inner wall forming a recessed part of the main housing part 4. The recess 36 is then closed by means of closure plate 56 so that the recess 36 defines a duct between the outlet 38 of filter element 22 and an inlet of the motor chamber 44.

The operation of the vacuum cleaner 2 will now be described.

Figure 3:
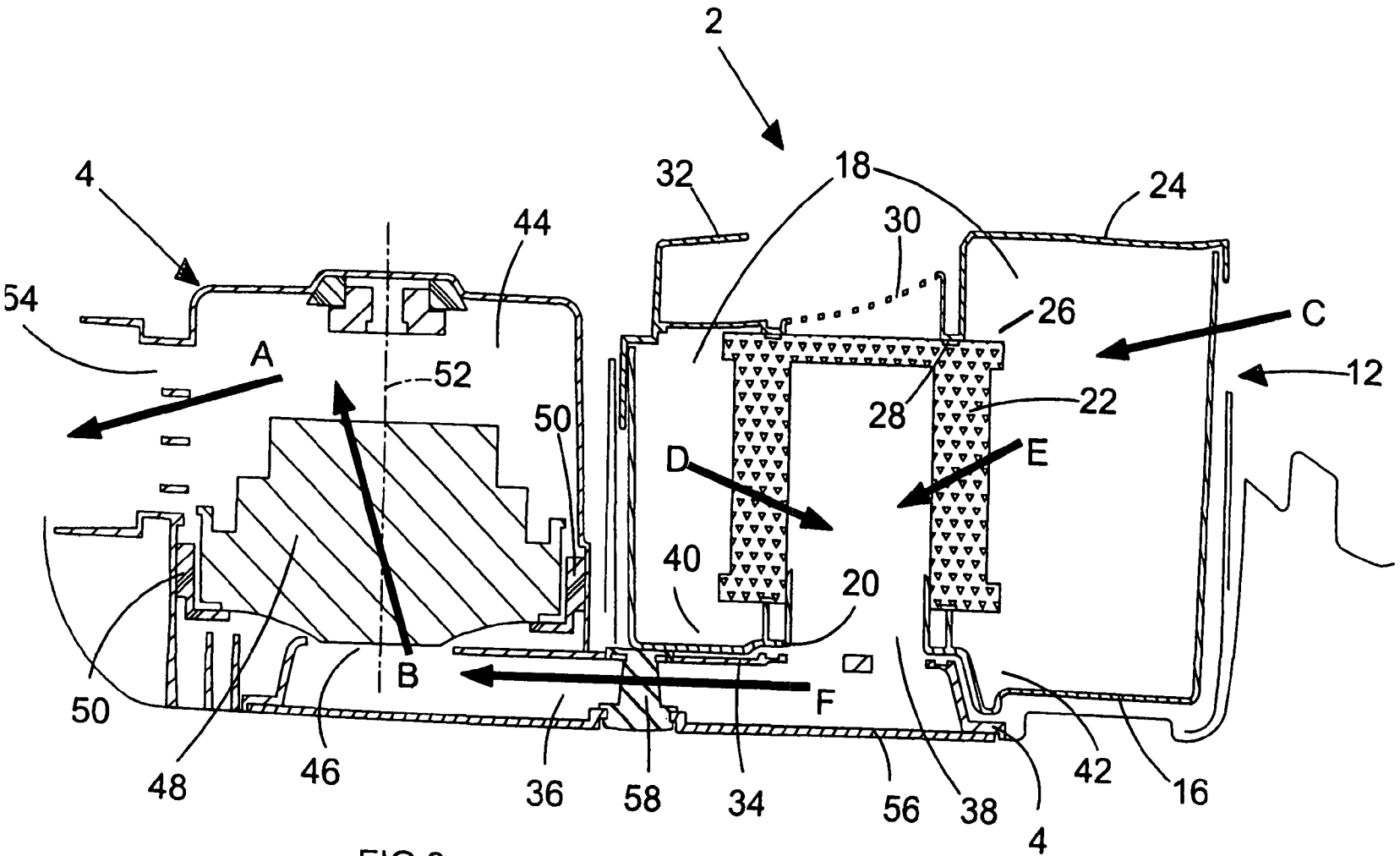
FIG. 3 is a view along the line A-A in FIG. 2.
Figure 4:
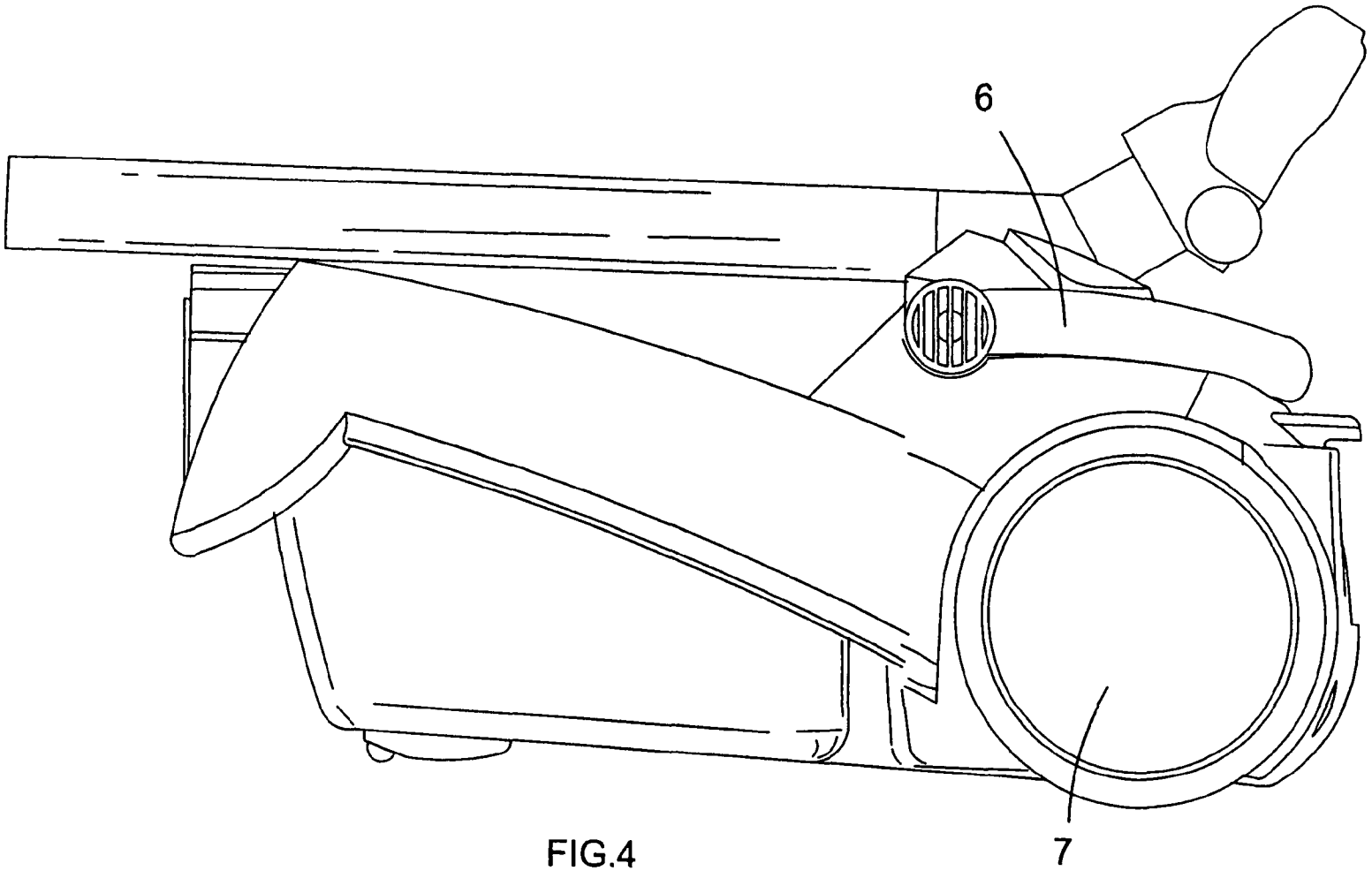
FIG. 4 is a side view of the vacuum cleaner of FIG. 1.

Actuation of motor 48 by means of ON/OFF switch 10 causes the fan to radially displace air out of outlets 54 in the direction of arrow A shown in FIG. 3. As a result, suction is caused upstream of the fan, which draws air from recess 36 generally axially into motor chamber 44 in the direction of arrow B. This in turn causes dirty air to be drawn through inlet 12 (to which a suitable accessory such as a floor cleaning head (FIG. 5) is connected by means of a flexible hose (FIG. 12)), and is drawn into dirt collection chamber 18 in the direction of arrow C and then inwardly through the walls of filter element 22 in the direction of arrows D and E. Because of annular seal 28 surrounding vent 30, the only source of air to the motor chamber 44 at negative pressure is via inlet 12.

Figure 8:
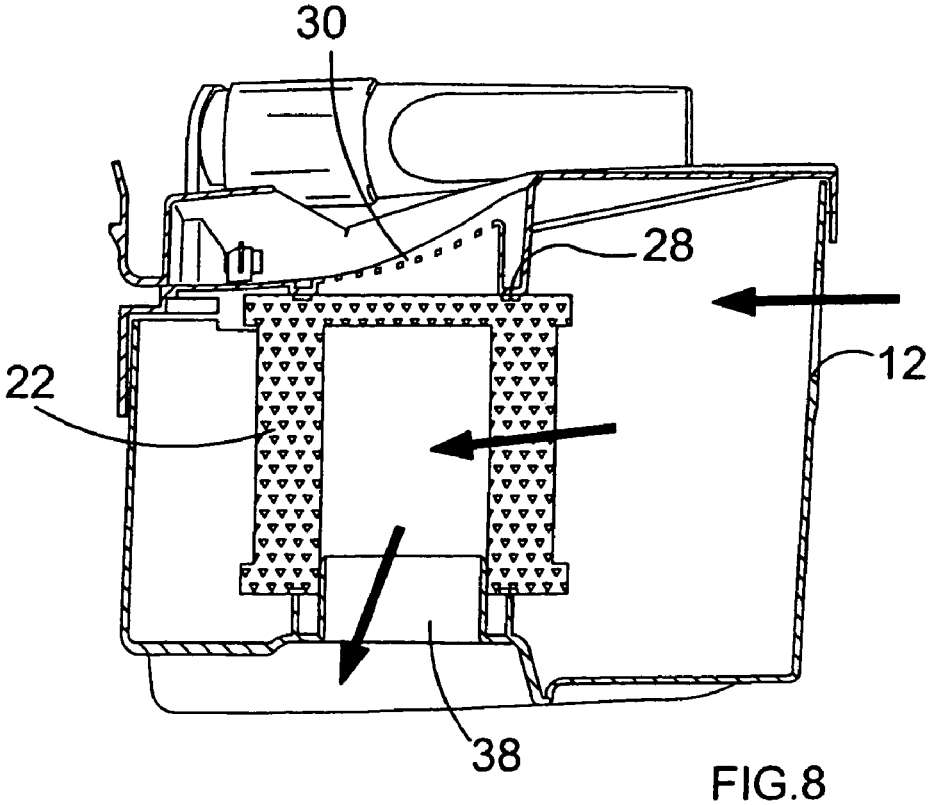
FIG. 8 is a sectional view along the line D-D in FIG. 7.

The air filtered by filter element 22 then passes out of aperture 38 and along the duct defined by recess 36 in the direction of arrow F. If the inlet 12 should become blocked (for example as a result of an obstacle coming into contact with it) the resulting pressure difference between the interior of recess 36 and the atmosphere causes bypass valve 58 to allow air to enter the recess 36 to prevent motor 48 from overheating. The air path from the inlet 12 to the outlet 38 via the filter element 22 is shown in more detail in FIG. 8.

Figure 10:
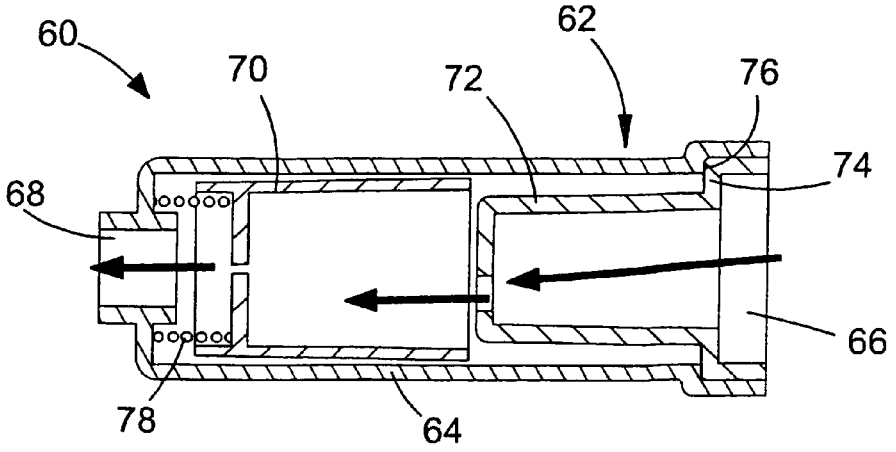
FIG. 10 is a cross-sectional view of a "filter full" indicator mechanism of the vacuum cleaner of FIG. 1.

Referring now to FIG. 10, a "filter full" indicator mechanism 60 is mounted to closure plate 56 in recess 36 at a part of the closure plate having a transparent window portion 62. The indicator mechanism 60 comprises a housing 64 having an inlet 66 into which air enters from externally of the vacuum cleaner housing 4 by means of a suitable valve, which may be the by-pass valve shown in FIG. 3. The housing 64 has an outlet 68 open to the interior of recess 36, and is provided with a green perforated cover member 70 which can slide axially relative to a red perforated flag member 72, which has a flange 74 abutting a corresponding recess 76 in the housing 64. The cover member 70 is urged over the flag member 72 by means of a compression spring 78.

In normal operation of the vacuum cleaner (i.e. in the absence of blockages in the air flow path and with clean filters in the filter element 22), the difference in air pressure between the outlet 68 and the inlet 66 is insufficient to displace the cover member 70 from the flag member 72 against the force of compression spring 78.

However, as the filter element 22 becomes blocked by dirt, the difference in pressure between the recess 36 and the atmosphere (and therefore between the outlet 68 and the inlet 66) increases, as a result of which the cover member 70 is displaced against the force of spring 78 from flag member 72, and the red colored flag member 72 can then be seen via transparent portion 62, providing the user with a visual indication that the filter needs to be cleaned.

Figure 9:
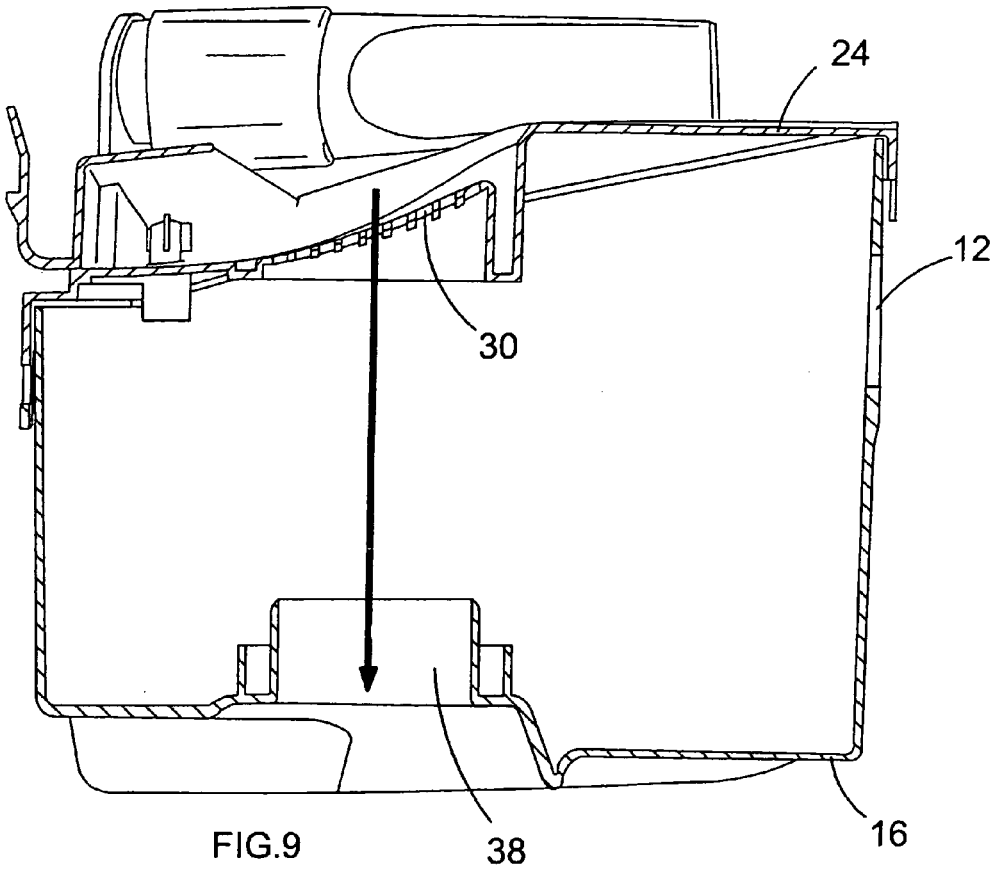
FIG. 9 is a sectional view, corresponding to FIG. 8, but with the filter element removed.

Referring back to FIG. 3, in order to clean the filter, the user lifts lid 24 by means of gripping portion 32, and then removes filter element 22 and dirt collection receptacle 16. Because the central portion of the dirt collection receptacle 16 is raised, dirt trapped on the outer surface of filter element 22 has a tendency to fall into trough regions 40, 42 and avoids falling into outlet 38. If the motor 48 should accidentally be actuated when the filter element 22 is removed, the opening provided by opened lid 24 is nearer to outlet 38 than inlet 12, as a result of which relatively clean air from the atmosphere passes into recess 36 in preference to dirty air from the inlet 12, thus minimizing the risk of the motor 48 being damaged by dirt. Even if the lid 24 should swing shut, relatively clean air passing through vent 30 still passes into duct 36 in preference to dirty air from inlet 12, in the absence of filter element 22 blocking the path of air through the vent 30 by means of seal 28. This arrangement is shown in more detail in FIG. 9.

Figure 5:
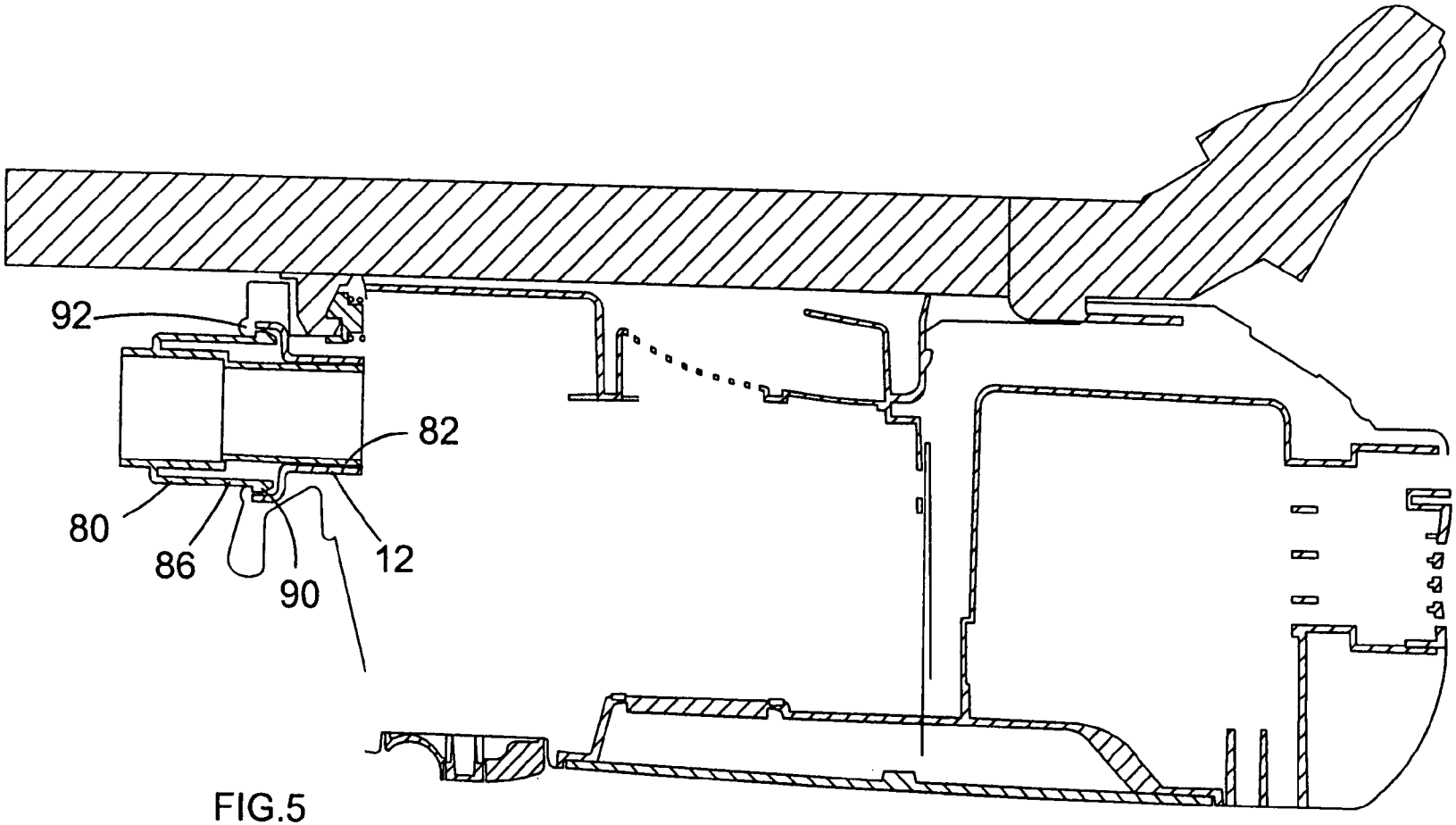
FIG. 5 is a sectional view along the line C-C in FIG. 1 with internal components of the vacuum cleaner removed.
Figure 6:
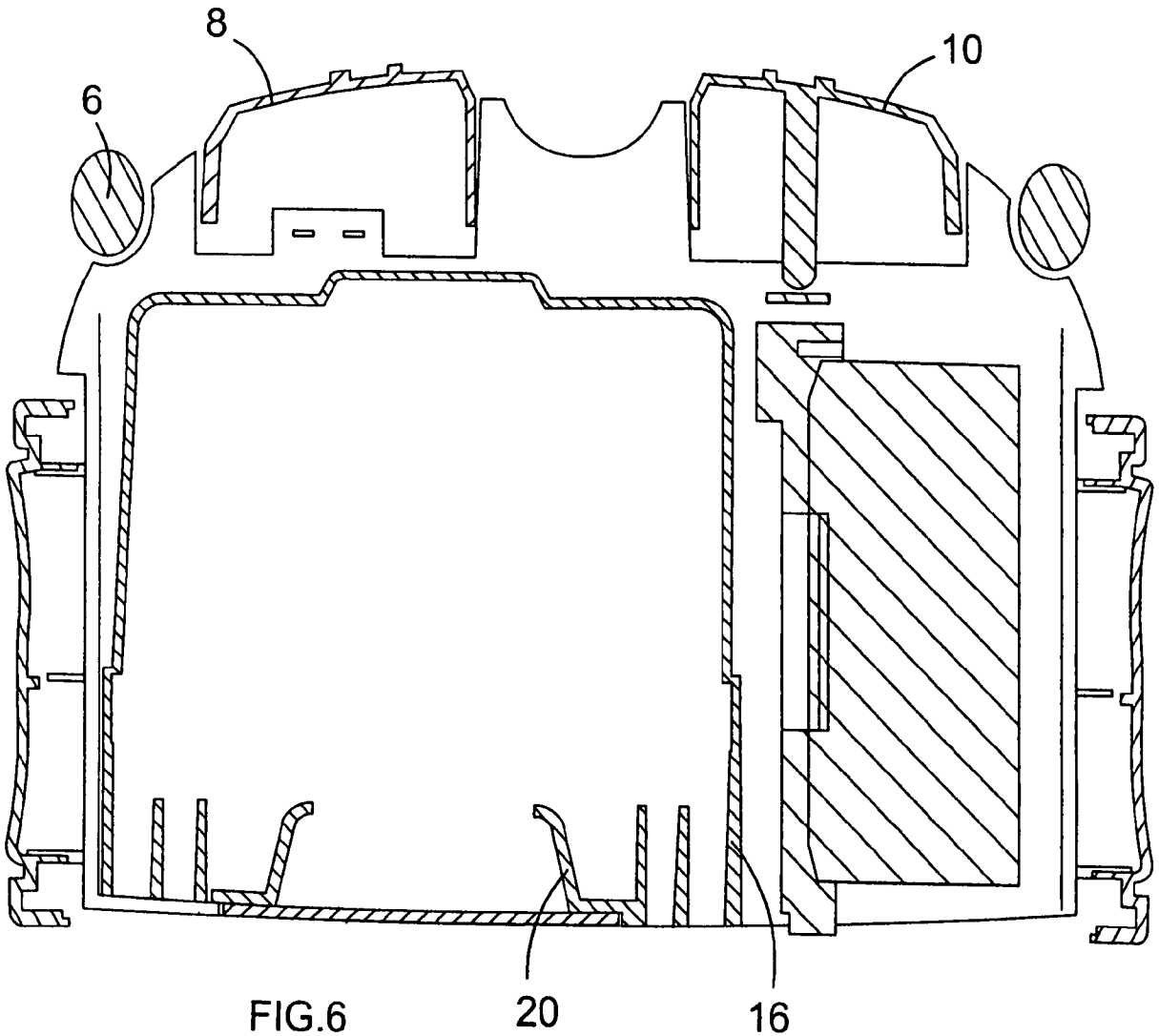
FIG. 6 is a sectional view along the line B-B in FIG. 1 with internal components of the vacuum cleaner removed.
Figure 7:
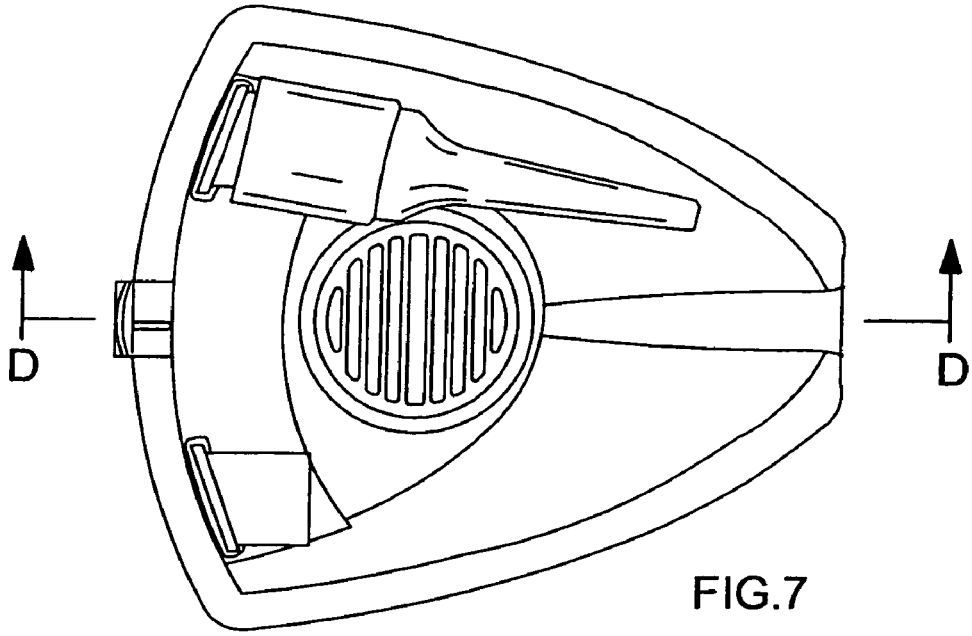
FIG. 7 is a plan view of a removable dirt container lid of the vacuum cleaner of FIG. 1.
Figure 12:
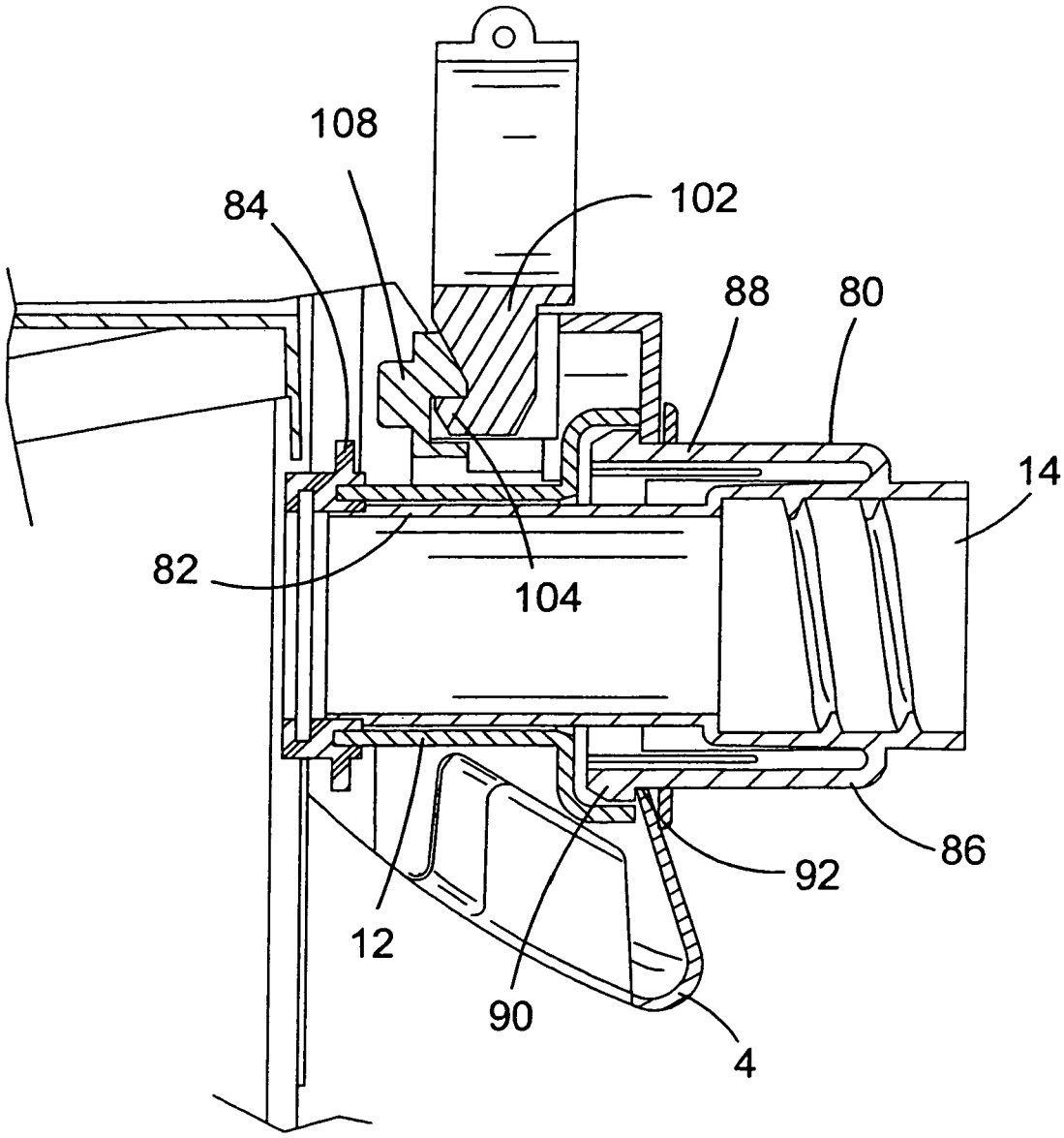
FIG. 12 is a cross-sectional view showing connection of a flexible hose to an inlet of the housing of the vacuum cleaner of FIG. 1.

Referring now to FIGS. 5 and 12, the flexible hose 14 is connected to housing inlet 12 by means of a hose connector 80 having a radially inner part 82 which cooperates with a rubber seal 84 (which also forms a seal with dirt collection receptacle 16) and a radially outer part 86 which is provided with resilient fingers 88 having heads 90, which locate behind edge portions 92 of the main housing part 4 to hold the connector 80 in position. In order to release the connector 80 from the housing 4, the resilient fingers 88 are pushed radially inwards until the heads 90 are released from the corresponding edge portions 92, so that the connector 80 can be axially withdrawn from the inlet 12.

Figure 11:
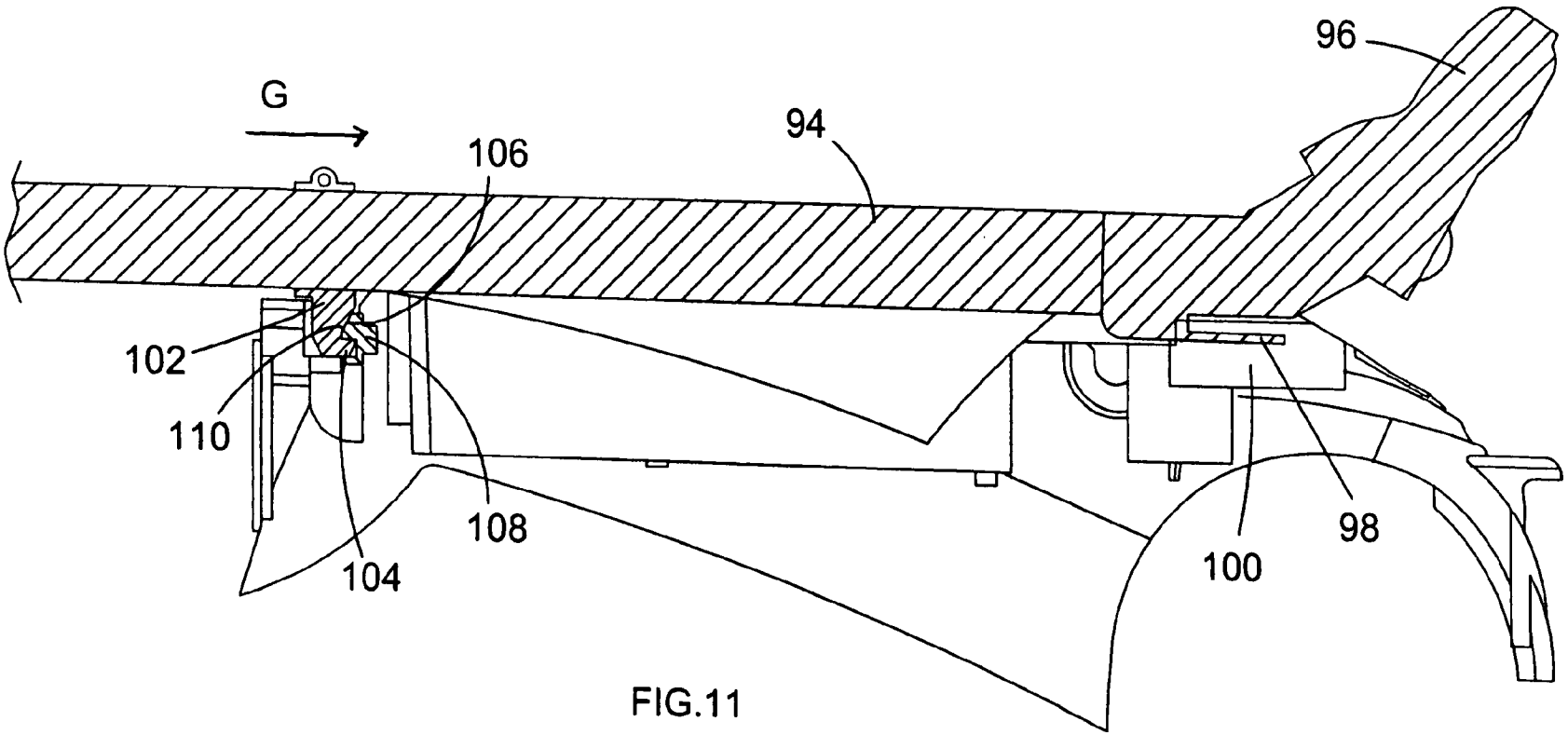
FIG. 11 is a sectional view of part of the housing of the vacuum cleaner of FIG. 1, with a floor-cleaning accessory mounted to the housing.

FIGS. 11 and 12 show a rigid tube 94 carrying a floor cleaning head 96 removably mounted to the housing 4 for storage by locating an elongate projection 98 provided on cleaning head 96 in a corresponding recess 100 on housing 4. A collar 102 surrounding tube 94 has a latching portion 104 and an inclined surface 106, and cooperates with a spring loaded latching member 108 on housing 4 having corresponding inclined surface 110. Movement of the upper part of the tube 94 shown in FIG. 11 in the direction of arrow G causes mutual engagement of latching portion 104 and inclined surface 110, as a result of which latching member 108 is displaced against the action of a spring (not shown) to cause latching portion 104 to be latched in position behind latching member 108 with inclined surfaces 106, 110 in contact with each other. In order to release the tube 94 from the housing 4, a release catch (not shown) is depressed to displace latching member 108 against the action of the spring so that the latching portion 104 of collar 102 can be withdrawn from the housing.

Figure 19:
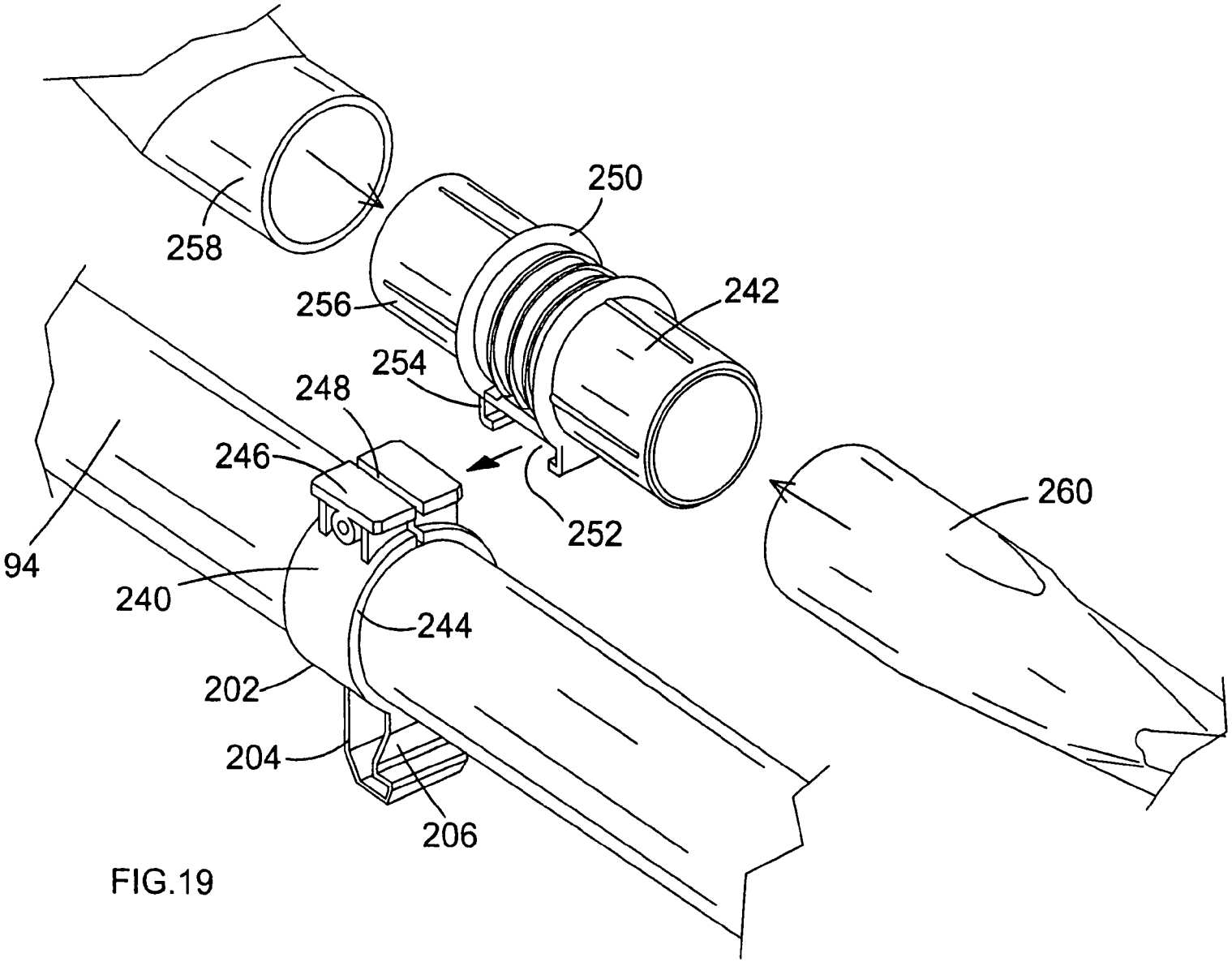
FIG. 19 is a perspective view of a device for mounting accessories to the vacuum cleaner for storage.

FIG. 19 shows a further embodiment of collar 202 for mounting to the rigid tube 94 and mounting the rigid tube 94 to the housing 4. Parts common to the embodiment of FIGS. 11 and 12 are denoted by like reference numerals but increased by 100.

The collar 202 is formed as two separate parts, a first part 240 formed as an injection moulded split ring and a tubular second part 242 which is removably attachable to the first part 240. The first part 240 has a tubular section 244 which is placed around the tube 94 and is formed on one side with latching portion 204 having inclined surface 206. The latching portion is formed as a hollow component to enable the first part 240 to be injection moulded while having sufficient strength. The first part 240 is also provided with a generally rectangular projection 246 divided by a groove 248 at the split part of tubular section 244, the projection 246 being arranged opposite the latching portion 204.

The second part 242 has an annular collar 250 having a slot 252 having an open end 254 and a closed end (not shown) for receiving the rectangular projection 246 on first part 240. The collar 250 surrounds a tubular body portion 256 having open ends for receiving an accessory 258, 260 at each end in an interference fit. The slot 252 can be mounted to the projection 246 from either direction, thus permitting left and right handed use of the collar 202, and the second part 242 is correctly located on the first part 240 by means of the closed end (not shown) of slot 252 and engagement of a projection (not shown) in slot 252 with groove 248 in projection 246. The orientation of the slot 252 relative to the body portion 256 is such that the body portion 256 and the accessories 258, 260 extend generally parallel to the longitudinal axis of tube 94. In this way, space can be particularly efficiently used for storing accessories 258, 260 on tube 94. Furthermore, by providing a collar 202 which serves the dual functions of mounting accessories 258, 260 to tube 94, and mounting tube 94 to the housing by means of latching portion 204, only a single component need by constructed, which reduces the cost of manufacturing the vacuum cleaner incorporating collar 202.

Figure 13:
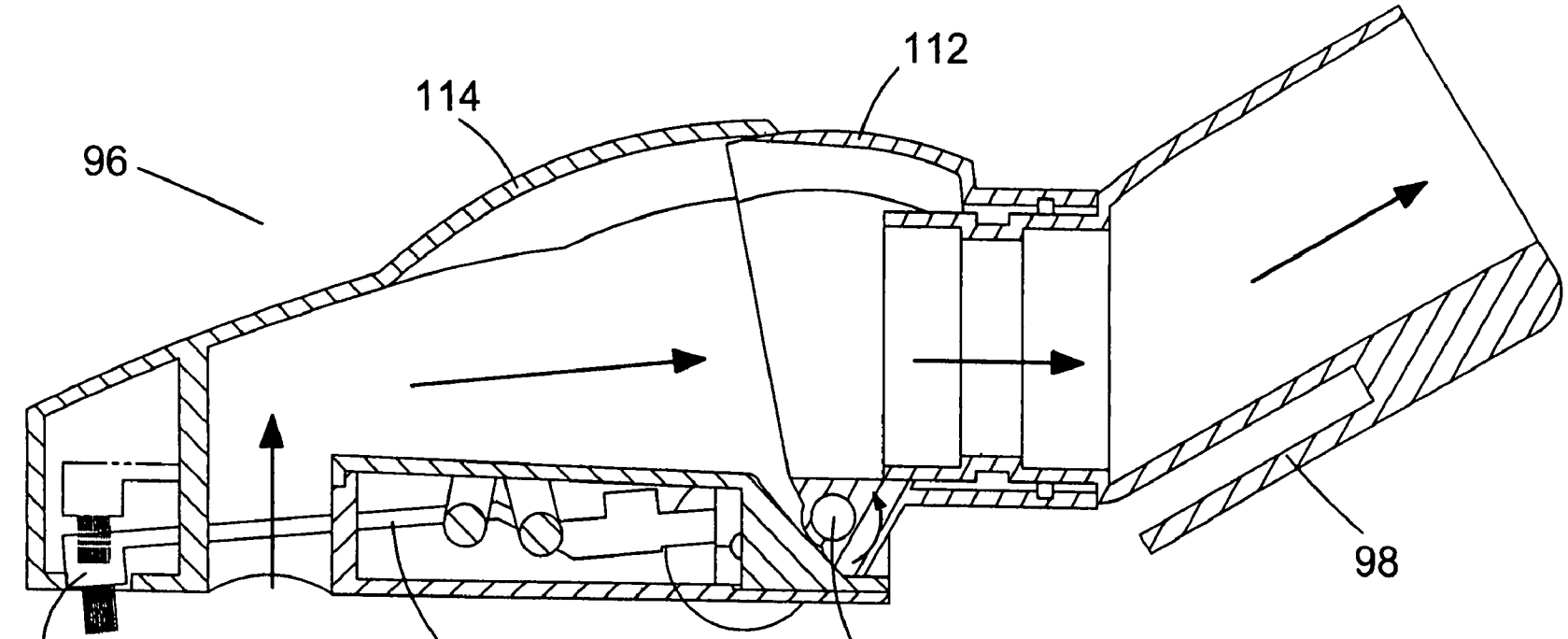
FIG. 13 is a cross-sectional view of a cleaning head of the floor-cleaning accessory of FIG. 11 with a rigid tube connected thereto in a lowered position.
Figure 14:
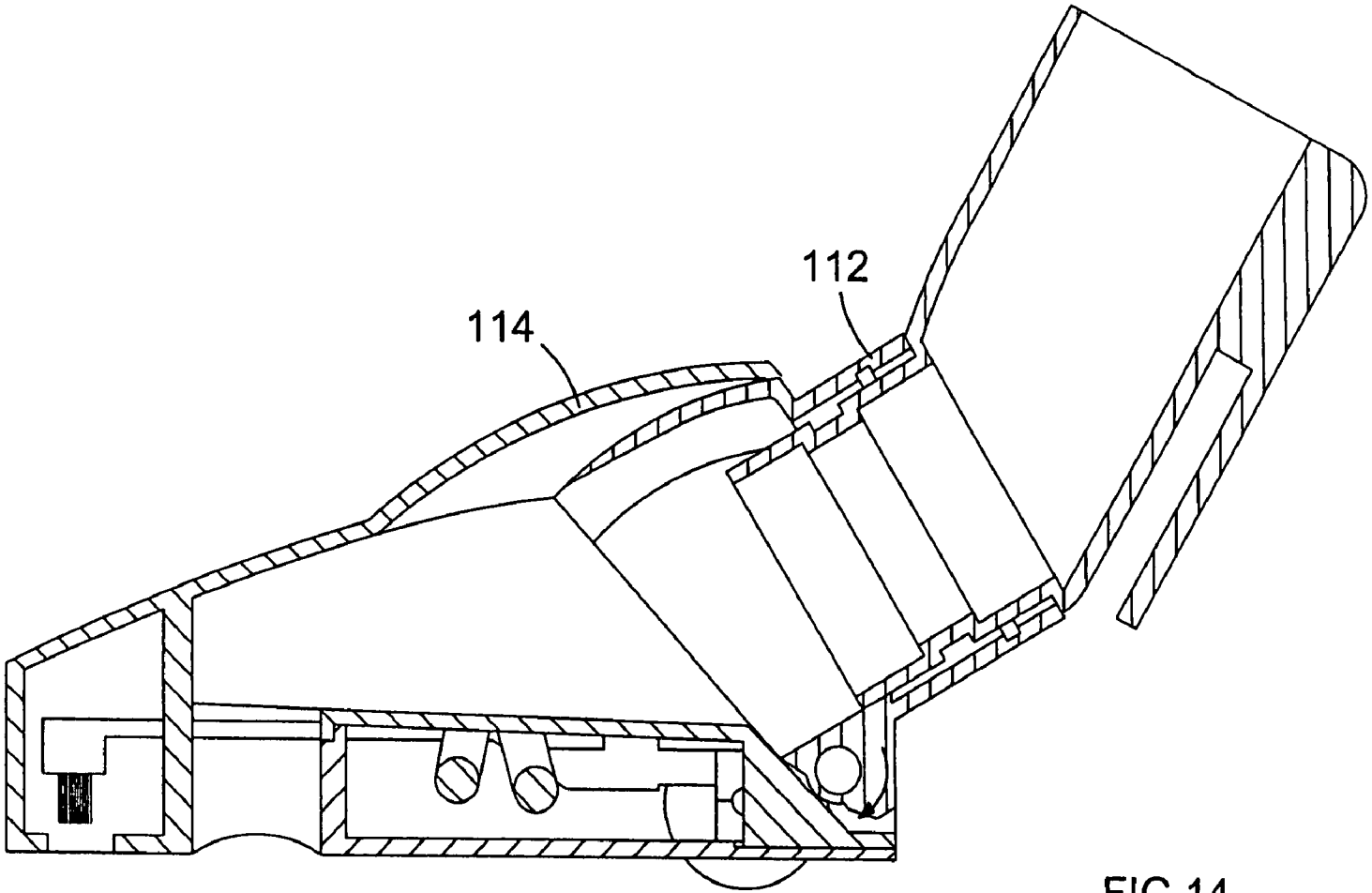
FIG. 14 is a sectional view, corresponding to FIG. 13, of the cleaning head of FIG. 13 with the rigid tube connected thereto in a raised position.
Figure 15:
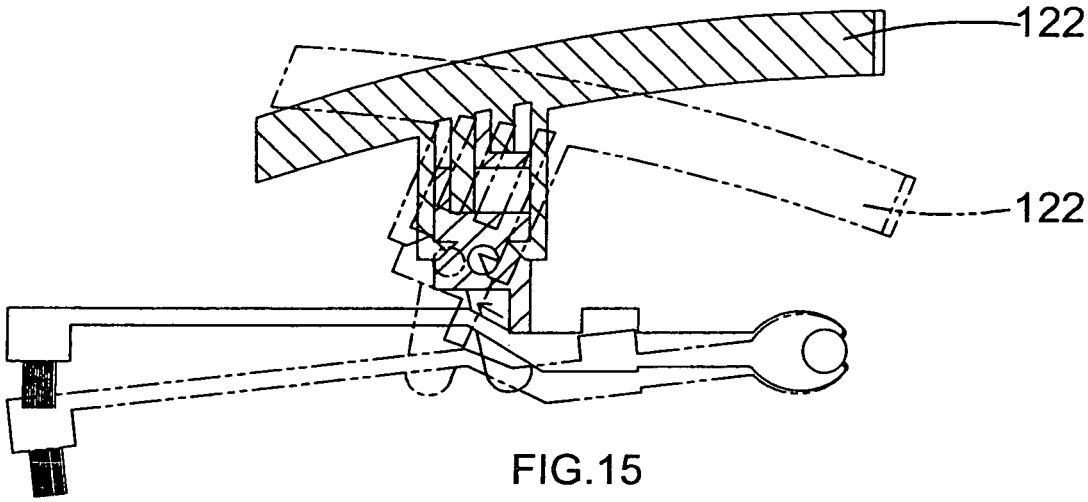
FIG. 15 is a schematic illustration of the operation of a mechanism for moving a brush plate between "brush up" and "brush down" positions in the cleaning head of FIG. 13.
Figure 18:
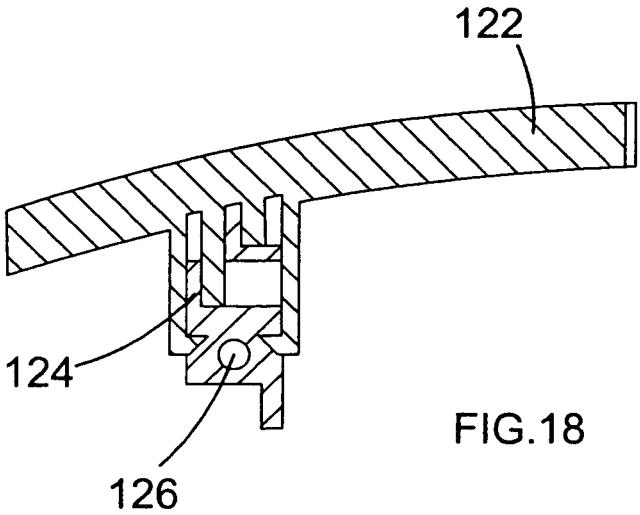
FIG. 18 is a schematic side cross-sectional view of the actuator mechanism of FIGS. 15 to 17.
Figure 16:
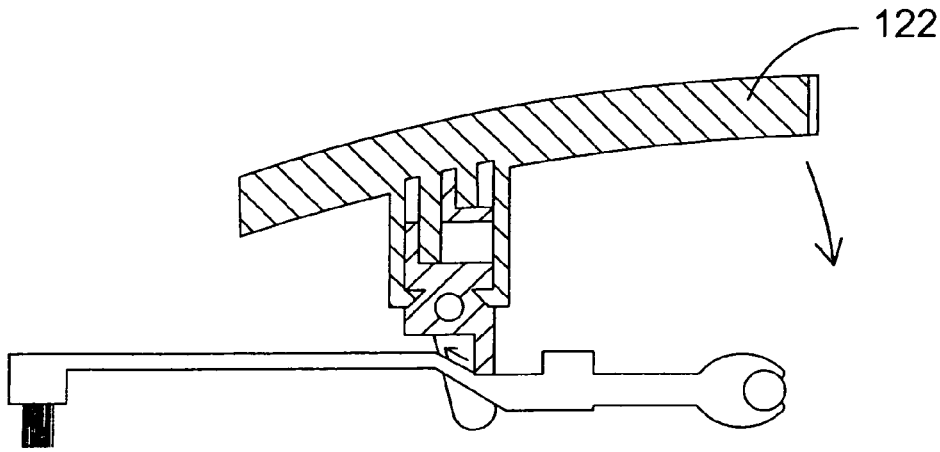
FIG. 16 is a schematic side view, corresponding to FIG. 15, of the brush plate and actuator mechanism in the "brush up" position.
Figure 17:
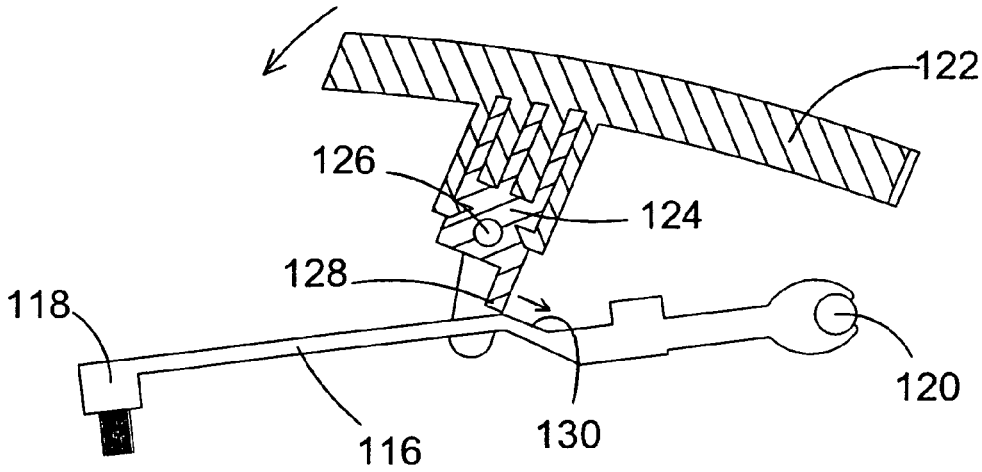
FIG. 17 is a schematic side view showing the brush plate and actuator mechanism in the "brush down" position.

FIGS. 13 to 18 show in more detail the floor cleaning head 96 shown in FIG. 11. The cleaning head 96 has a connector portion 112 pivotally mounted to a head portion 114, so that the angle of the connector portion 112 relative to the head portion 114 can be adjusted, as shown in FIGS. 13 and 14.

A brush plate 116 carries a brush member 118 and is connected to a pivot 120 located at the rear of the head portion 114. The position of the brush member 118 relative to the head portion 114 is adjusted by means of a lever 122 (FIGS. 15 to 18) carrying actuator member 124 which pivots about axis 126 to move a projection 128 on actuator member 124 along an inclined surface 130 of brush plate 116. This causes pivotal movement of brush plate 116 about pivot 120 to move the brush member 118 between "brush up" and "brush down" positions. The brush plate 116 is urged into the "brush up" and "brush down" positions by means of suitable springs (not shown).

It will be appreciated by persons skilled in the art that the above embodiment has been described by way of example only, and not in any limitative sense, and that various alterations and modifications are possible without departure from the scope of the invention as defined by the appended claims. For example, the body portion 256 of FIG. 19 may extend generally at right angles to the longitudinal axis of tube 94.

The invention claimed is:

1. A vacuum cleaner comprising:

a housing having a first inlet for allowing intake of air and a first outlet for allowing exhaust of air;

suction means for causing air to flow from said first inlet to said first outlet;

a filter element located in said housing for removing particles larger than a predetermined size from air flowing from said first inlet to said suction means, said filter element adapted to be removed from said housing;

a second inlet having a lid with an open condition for enabling said filter element to be removed from said housing, and a closed condition, wherein when the filter element is present in said housing air from said first inlet passes to said suction means, and when the filter element is removed air from said second inlet passes to said suction means;

a dirt collection receptacle having an outlet, wherein said filter element is mounted to the dirt collection receptacle outlet such that air passing from the first inlet to said suction means passes through said filter element; and wherein said dirt collection receptacle is removable from said housing.

2. The vacuum cleaner according to claim 1, wherein said dirt collection receptacle comprises a respective recess adjacent the dirt collection receptacle outlet.

3. A vacuum cleaner comprising:

a housing having a first inlet for allowing intake of air and a first outlet for allowing exhaust of air;

suction means for causing air to flow from said first inlet to said first outlet;

a filter element located in said housing for removing particles larger than a predetermined size from air flowing from said first inlet to said suction means, said filter element adapted to be removed from said housing; and a second inlet having a lid with an open condition for enabling said filter element to be removed from said housing, and a closed condition, wherein when the filter element is present in said housing air from said first inlet passes to said suction means, and when the filter element is removed air from said second inlet passes to said suction means; and wherein said lid comprises a vent for allowing intake of air in said closed condition when said filter element is removed from said housing.

4. The vacuum cleaner according to claim 3, wherein when the filter element is present in said housing the lid contacts the filter element in the closed position to prevent air from entering through the second inlet.

5. The vacuum cleaner according to claim 4, wherein said filter element is mounted to said dirt collection receptacle for removal therewith from said housing.

* * * * *